US005314360A

United States Patent [19]

Jaag

[11] Patent Number: 5,314,360

[45] Date of Patent: May 24, 1994

[54] TERMINAL BLOCK

[75] Inventor: Dieter Jaag, Villingen-Schwenningen, Fed. Rep. of Germany

[73] Assignee: RIA Electronic Albert Metz, Blumberg, Fed. Rep. of Germany

[21] Appl. No.: 959,041

[22] Filed: Oct. 9, 1992

[30] Foreign Application Priority Data

Oct. 9, 1991 [DE] Fed. Rep. of Germany ..... 9112548

[51] Int. Cl.[5] ..... H01R 4/40

[52] U.S. Cl. ..... 439/811; 439/806

[58] Field of Search ..... 439/806, 811, 810, 814, 439/815, 709

[56] References Cited

U.S. PATENT DOCUMENTS 4,331,377 5/1982 Ebbinghaus et al. ..... 439/811

5,192,234 3/1993 Heng et al. ..... 439/806

FOREIGN PATENT DOCUMENTS 1026840 2/1978 Canada ..... 439/815

1274709 8/1968 Fed. Rep. of Germany .

3922072A1 1/1991 Fed. Rep. of Germany .

*Primary Examiner*—Gary F. Paumen

*Attorney, Agent, or Firm*—Lackenbach Siegel Marzullo & Aronson

[57] ABSTRACT

A terminal block is described in which each pole comprises a screw clamp (12, 14, 16) with a conductor protection element (20, 24) and a plug contact (18). The contact blades (26, 28) of the plug contact (18) are formed in each instance as a one-piece sheetmetal stamping with the conductor protection element (20) and bring about the electrically conducting connection between the screw terminal (12, 14, 16) and the plug contact (18).

9 Claims, 2 Drawing Sheets

TERMINAL BLOCK

BACKGROUND AND SUMMARY OF THE INVENTION

This invention relates generally to terminal blocks and the like.

A terminal block of this type is known from German Patent Publication DE 39 22 072 Al. In this known terminal the plug contact consists of a bushing designed as a blind hole of the clamp body in which the contact blades are inserted. Such form of the clamp body is quite difficult to manufacture. Besides, a step of inserting the contact blades into the body complicates the assembly body for manufacture. Besides, inserting the contact blades constitutes.

It is the object of the invention to design a terminal block of the type referred to in such a way that its manufacture and assembly are further simplified and thus become more cost-efficient.

One of the ways to solve the above mentioned problem is to provide a terminal block contact blades which are formed during one-piece sheetmetal stamping along with the conductor protection element and are disposed in a bushing of the terminal housing.

In the case of the terminal block according to the invention, the conductor protection elements of the screw clamp are made and assembled in one piece with the contact blades of the plug contacts. The conductor protection elements and the contact blades are stamped in a single stamping operation from a sheetmetal strip and can be assembled as a cohering unit. This reduces the mannufacturing as well as the assembly costs. As the blades form a cohering unit with the conductor protection element, electrically conducting contact between a wire conductor clamped in the conductor receiving passage of the clamp body and a plug pin inserted into the plug is ensured. An electrically conducting connection of the contact blades with the clamp body is immaterial, so that the blades can be inserted into a bushing of the terminal housing made of plastic, which permits a simpler design and reduces the material requirement of the clamp body.

Generally the terminal block is made as a multi-pole terminal with several clamp bodies in one terminal housing. This results in results in further simplifies the manufacture and assembly. The conductor protection elements are stamped from the sheetmetal strip with the contact blades of all poles of the terminal, the stampings of the individual poles hanging together also through a longitudinal strip of the stamping strip which originates at one of the contact blades. The free legs of the conductor protection elements are then bent in U form and the clamp bodies are slipped onto the bent legs. The stamped parts are thus pre-assembled with the clamp bodies, the connecting longitudinal strip is removed and the contact blades are bent, whereupon the clamp bodies with the stampings are inserted into the housing. Largely automatic assembly by machine is thus possible.

In a preferred embodiment, the axis of the plug is perpendicular to the axis of the conductor receiving passage behind the end face of the clamp body opposite the conductor receiving passage. In this embodiment, appropriately the edge of the rear end face of the clamp body is formed as a bending edge over which the contact blades are bent away from the conductor protection element. Appropriately the rear end face is slanted in such a way that the contact blades can be bent over this bending edge by an angle of more than 90° Due to the residual elasticity left during the bending, after release the contact blades then maintain the desired bending angle of 90° stress-free.

BRIEF DESCRIPTION OF THE DRAWINGS

The invention will be explained more specifically below with reference to an embodiment illustrated in the drawing, in which.

DESCRIPTION OF THE PREFERRED EMBODIMENT

Figure 2:
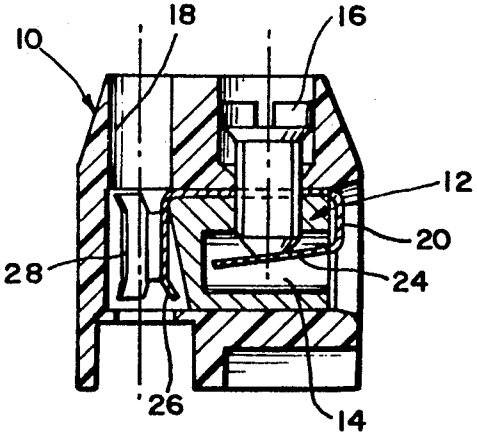
FIG. 2, a section along line II—II of FIG. 1.

In the embodiment illustrated in the drawing, the terminal block is shown as a five-pole terminal. In a plastic terminal housing 10, five recesses are arranged side by side on the end face, in each recess a metallic clamp body 12, preferably produced by die casting, is inserted. The clamp bodies 12 have on the end face a conductor receiving passage 14, formed as a blind hole. Perpendicular to the axis of the conductor receiving passage 14, is a threaded bore, into which a cylindrical binding post 16 can be screwed which is captive in the terminal housing 10, which leads from above through the clamp body 12 into the conductor receiving passage 14.

Behind the recesses for the clamp bodies 12 there are arranged in the terminal housing 10 bushings 18 extending in each instance perpendicular to the axis of the conductor receiving passage 14, which bushings extend in the housing 10 behind the rear end face of the inserted clamp bodies 12, away from the conductor receiving passage 14.

Figure 5:
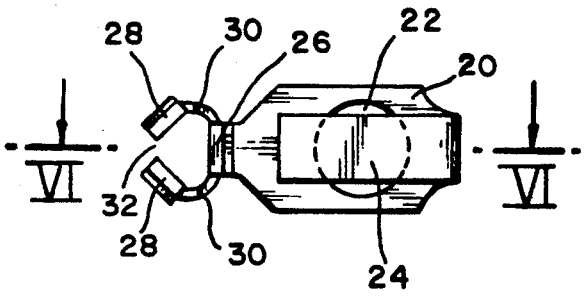
FIG. 5, a view of the sheetmetal stamping of the terminal from below.
Figure 6:
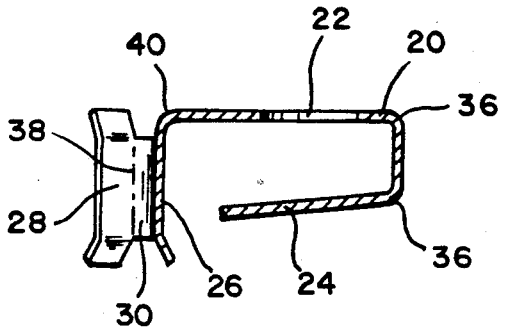
FIG. 6, a section along line VI—VI in FIG. 5.

Associated with each clamp body 12 is a sheetmetal stamping, as illustrated in FIGS. 5 and 6. The stampings have a strip type elongated conductor protection element 20, which has a circular opening 22 for the binding screw 16 and whose free leg 24 is bent in U form. On the end face the free leg 24 engages into the conductor mount 14, while the conductor protection element 20 rests with its opening 22 on top of the clamp body 12 in such a way that the opening 22 coincides with the threaded bore of the clamp body 12.

Contiguous to the conductor protection element 20 as one piece, the sheetmetal stamping has three contact blades 26, 28. The contact blades 26, 28 are parallel to each other, the two outer contact blades 28 hanging together with the central contact blade 26 through a cross-bar 30. The central contact blade 26, being an aligned extension of the conductor protection element 20, is integral therewith. The central contact blade 26 is bent at right angles to the conductor protection element 20. The cross-bars 30 of the two lateral contact blades 28 are bent relative to the central contact blade 26 in such a way that the three contact blades 26 and 28 include essentially a mount cross-section in the form of an equilateral triangle, as can best be seen in FIG. 5. Once the clamp body 12 with the stamping has been inserted into the housing 10, the contact blades 26, 28 are inside the bushing 18, their triangular mount cross-section being oriented coaxial with the bore 18. When a plug pin 32 is introduced into the bushing 18, it is therefore pushed into the mount cross-section of the contact blades 26, 28, as is shown as a dash-dot line in FIG. 5, with the elastic spring force of the cross-bar 30 creating the contact pressure between the contact blades 26, 28 and the plug pin 32.

Figure 4:
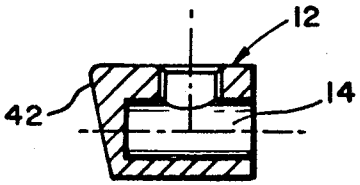
FIG. 4, a section corresponding to FIG. 2 through the clamp body.
Figure 1:
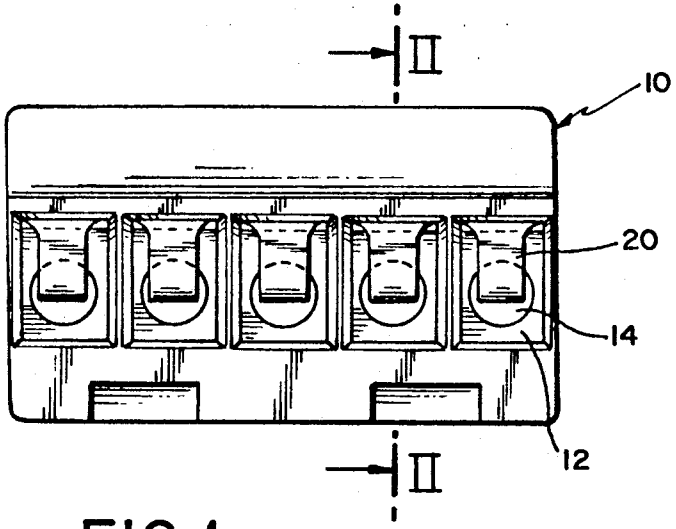
FIG. 1 shows an end view of the conductor mount side of the terminal block.
Figure 3:
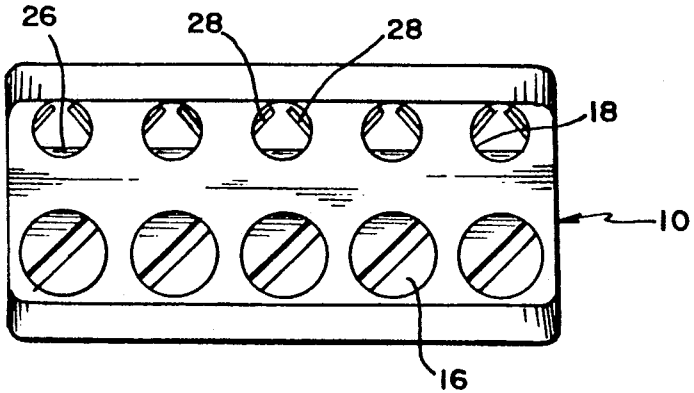
FIG. 3, a top view onto the terminal block.
Figure 7:
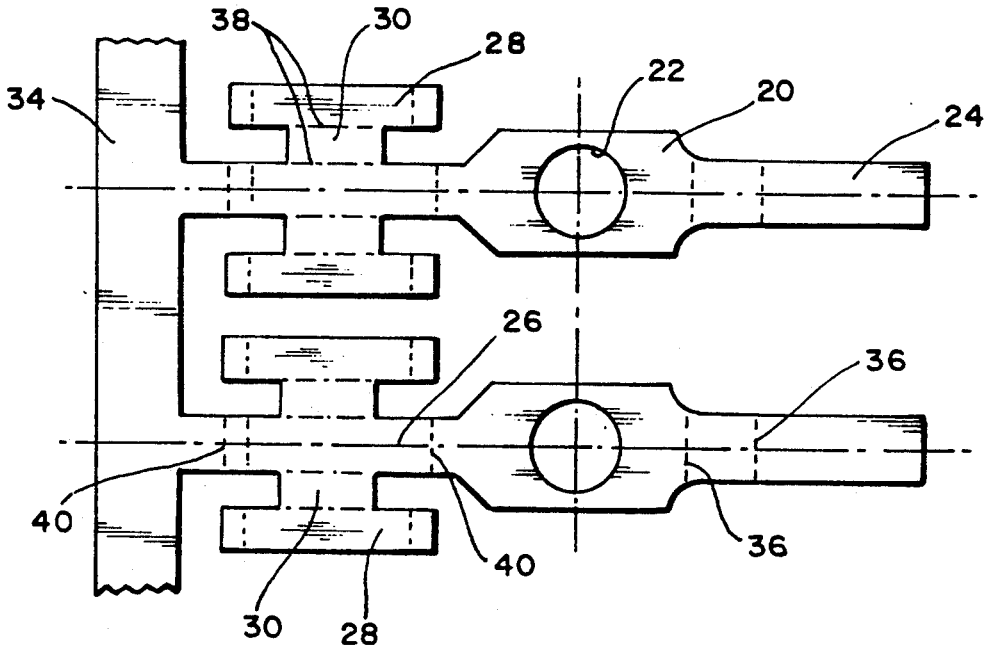
FIG. 7, a detail of a stamped strip in which several sheetmetal stampings hang together.

For the manufacture, the sheetmetal stampings of all poles of a terminal block are stamped from a stamping strip in one operation, with the stampings of the individual poles being still connected with one another through a longitudinal strip 34 which attaches to the central contact blade 26, as shown in FIG. 7. The stampings, hanging together through the longitudinal strip 34, are placed into a machine in which first the free legs 24 of the conductor protection elements 20 are bent along the edges 16 shown dashed in FIG. 7. Then the clamp bodies 12 are slipped onto these free legs 24. In a subsequent operation the lateral contact blades 28 are bent around the edges 38 against the central contact blade 26. Then the central contact blades 26 are bent downward around the edge 40 opposite the conductor protection element 20. For the bending of the central contact blade 26 around the edge 40, the upper edge of the rear end face 42 of the terminal bodies 12 serves as bending edge. To this end, the rear end face 42 of the clamp bodies 12 is slanted against the plane perpendicular to the axis of the conductor receiving passage 14 by an angle of 10°, as FIG. 4 shows. This makes it possible to bend the central contact blade 26 around the rear upper edge of the clamp bodies 12 over an angle of more than 90° When after the bending process the bending tool releases the contact blades 26, they detach again from the rear end face 42 of the clamp bodies 12 due to their residual elasticity and occupy (then stress-free) a position perpendicular to the conductor protection element 20, as can be seen in FIG. 2. By the angular bending of the central contact blade 26 the clamp bodies 12 are retained on the free legs 24 of the conductor protection elements 20, and after removal of the longitudinal strip 34 along the stamping line 44 the clamp bodies 12 with the sheetmetal stampings can be inserted into the terminal housing 10.

I claim:

1. A terminal block comprising:

at least one clamp body having a front end and a rear face, a conductor receiving passage extending within said clamp body between said front end and said rear face, a bore within said clamp body, said bore receiving a binding post;

a terminal housing with at least one mounting unit, said unit having a front opening and a bushing aperture, an interior part extending within said terminal housing from said front opening to said bushing aperture;

a conductor protection element including at least a free leg, a plurality of contact blades, and said conductor protection element and said plurality of the contact blades being formed as one coherent unit;

whereby said clamp body is insertable into said interior part of the housing through said front opening, in an assembled condition of said terminal block at least said free leg of said conductor protection element being situated within said conductor receiving passage and said plurality of contact blades is situated within said bushing aperture adjacent to said rear face of said clamp body.

2. A terminal block according to claim 1, further comprising said plurality of contact blades including first, second and third contact blades, wherein said first contact blade forms an extension of said conductor protection element, so that a longitudinal axis of said conductor protection element coincides with a longitudinal axis of said first contact blade, said second and third contact blades are each connected to said first contact blade through a cross bar.

3. A terminal block according to claim 2, wherein said conductor protection element the said contact blades are formed by one-piece sheet metal stamping.

4. A terminal block according to the claim 1 wherein said rear face of said clamp body is positioned at an acute angle to a plane which is substantially perpendicular to an axis of said conductor receiving passage.

5. A terminal block according to claim 4, wherein said acute angle is about 4°.

6. A terminal block according to claim 4, wherein at least one said contact blade is bent over projecting edges of said rear face of said clamp body.

7. A terminal block according to claim 3, wherein said conductor protection element rests on top of said body clamp in such a manner that said bore at the clamp body coincides with an opening in the terminal housing, so that said binding post passing through said bore and said opening in the terminal housing engages said free leg of the conductor protection element.

8. A terminal block according to claim 7, wherein a longitudinal axis of said bore is transverse to a longitudinal axis of said conductor receiving passage.

9. A terminal block according to claim 3, wherein said conductor protection element is positioned between a top portion of said body clamp and said interior part of the terminal housing.

* * * * *